US005080021A

United States Patent [19]

Thorsen

[11] Patent Number: 5,080,021

[45] Date of Patent: Jan. 14, 1992

[54] APPARATUS AND METHOD FOR CORRECTING SKEW OF A TRAVELING CRANE

[75] Inventor: George E. Thorsen, Wauwatosa, Wis.

[73] Assignee: Harnischfeger Corporation, Brookfield, Wis.

[21] Appl. No.: 503,348

[22] Filed: Apr. 2, 1990

Related U.S. Application Data

[63] Continuation of Ser. No. 211,187, Jun. 23, 1988, abandoned.

[51] Int. Cl.[5] ..... B61F 13/00

[52] U.S. Cl. ..... 105/163.2

[58] Field of Search ..... 105/163.2, 163.1; 104/98; 295/34

[56] References Cited

U.S. PATENT DOCUMENTS

| | | | |
|---|---|---|---|
| 1,858,929 | 5/1932 | Harry | 105/163.2 |
| 2,601,831 | 7/1952 | Caillard | 105/163.2 |
| 3,095,825 | 7/1963 | Dehn | 105/163.2 |
| 3,166,023 | 1/1965 | Lynd | 105/163.2 |

FOREIGN PATENT DOCUMENTS

| | | | |
|---|---|---|---|
| 0745912 | 12/1943 | Fed. Rep. of Germany | 105/163.2 |
| 0575727 | 4/1958 | Italy | 105/163.2 |
| 0334768 | 1/1959 | Switzerland | 105/163.2 |
| 0623813 | 9/1978 | U.S.S.R. | 105/163.2 |

*Primary Examiner*—Robert J. Oberleitner
*Assistant Examiner*—Mark T. Le
*Attorney, Agent, or Firm*—Richard C. Ruppin

[57] ABSTRACT

A skew correction apparatus for a crane traveling on generally parallel spaced apart rails and having a drive wheel on each rail rotatably driven at the same speed. The drive wheels each have center cylindrical portions riding on a rail head and inside and outside flanges facing the sides of the rail head and having a larger diameter than the diameter of the center portion. The clearance distance between the inside flange of each drive wheel and the rail side it faces is smaller than the clearance distance between the outside flange and the rail side the outside flange faces. Thus, if the drive wheels and thereby the crane become skewed, only the inside drive wheel flanges will engage the rail sides. The lagging wheel of the skewed wheels will rotate against the rail side on the larger flange diameter of the wheel and tend to ride up on the rail side. Rotating on the larger flange diameter will increase the linear speed of the lagging wheel, since it continues to rotate at the same rotating speed as the leading wheel, so that it will catch up with the leading wheel and thereby correct the skew.

11 Claims, 2 Drawing Sheets

APPARATUS AND METHOD FOR CORRECTING SKEW OF A TRAVELING CRANE

This is a continuation of copending application Ser. No. 07/211,187 filed on June 23, 1988, now abandoned.

FIELD OF THE INVENTION

This invention relates to overhead traveling cranes which operate on spaced apart rails and, in particular, to the correction of skewing of such cranes on their rails.

BACKGROUND OF THE INVENTION

Overhead cranes which travel on their wheels along spaced apart generally parallel rails are subject to the continuous problem of the skewing of the crane on the rails. The forces causing skewing are due to rail displacement caused by rail support changes, rail deterioration resulting from improper adjustment of acceleration and deceleration forces of drive motors and brakes, and variations in traction due to rail contamination from moisture vapor and airborne particles. The skewing itself exacerbates the problem since it produces stresses on the rail structure which contribute further to the displacement of the rails. Moreover, the skewing causes severe stressing and wear of the crane wheels. The end result of rail displacement and deterioration and consequent increased skewing is a short wear life of the rails requiring their relatively frequent replacement and very frequent replacement of the wheels.

Various prior art solutions to the skewing problem have been developed. These include controls in which a sensing device is used for detecting skew and adjusting the drive motors of the crane to correct the skew. For example, in a crane having driving wheels at opposite bridge ends of the crane independently driven, slowing the motor of the drive wheel at the leading skewed bridge end will correct the skew. Another approach, upon sensing skew of the bridge, is to either apply a friction drag to the leading skewed end of the bridge or activate a wheel brake on the leading drive wheel of the skewed bridge. A further solution, disclosed in U.S. Pat. No. 3,095,829 to Dehn, in a crane having drive wheels driven and controlled independently, is to decrease the clearance between the rail and the outside flange of each of the drive wheels. Consequently, the outside flange of the leading drive wheel, when the crane moves to a skewed position, will contact the outer side of the rail on which it rides and cause that wheel as well as its drive system to slow down due to the resulting friction and thereby correct the skew. The skew sensing devices used in prior art skew correction methods have typically been contacting devices such as rollers which are connected to switches and proximity type switches mounted on the crane which will provide an output signal indicative of their distance from the rail.

The problem with the prior art anti-skewing devices is that they rely on either a separate drive for the drive wheels on the opposite ends of the crane bridge or on variable speed drives so that one wheel can travel at a different speed than the other. With these types of drive systems, it is possible to slow the lead wheel in a suitable manner so that the crane returns to a parallel running position relative to the rails on which it travels.

SUMMARY OF THE INVENTION

It is a general object of the invention to provide a method and apparatus for correcting skew of a traveling crane operating on spaced apart rails in which the drive wheels that rotate on the spaced apart rails always rotate at the same speed.

The invention is accomplished by providing a crane supported on spaced apart generally parallel rails by a plurality of wheels including a drive wheel traveling on each of the parallel rails. Interconnecting means connects the drive wheels traveling on the spaced apart rails such that they rotate at the same speed. Each of the two drive wheels has a single diameter cylindrical surface traveling at a linear speed on the rail it engages and first and second axially spaced apart flanges having a larger diameter than the diameter of the cylindrical surface. The first and second flanges of each wheel respectively face an inner side and an outer side of the rail on which the wheel of which they are a part travels. The distance of the space of the first flange of each wheel from the inner side of the rail which it faces is such that only the first flanges of the wheels engage the sides of the rails when the crane becomes skewed. Thus, in a skewed position of the crane, the lagging wheel will rotate its first flange against the rail at its larger diameter relative to the diameter of the cylindrical surface of the wheel. Consequently, the first flange of the lagging wheel, in effect, rotates on to the rail and thereby travels linearly at a higher speed than that of the leading wheel. The result is that the lagging end of the skewed crane catches up with the leading end of the crane and the skew is corrected. The side walls of the first flanges of the wheels which face the inner side of the rails may be tapered or angled in a direction away from the rail. Thus, when the crane is skewed and the first flange of the lagging wheel engages the inner side of the rail, the angle of the facing side wall of the flange will facilitate the rotation of the wheel on to the larger diameter of the flange as the wheel travels along the rail.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
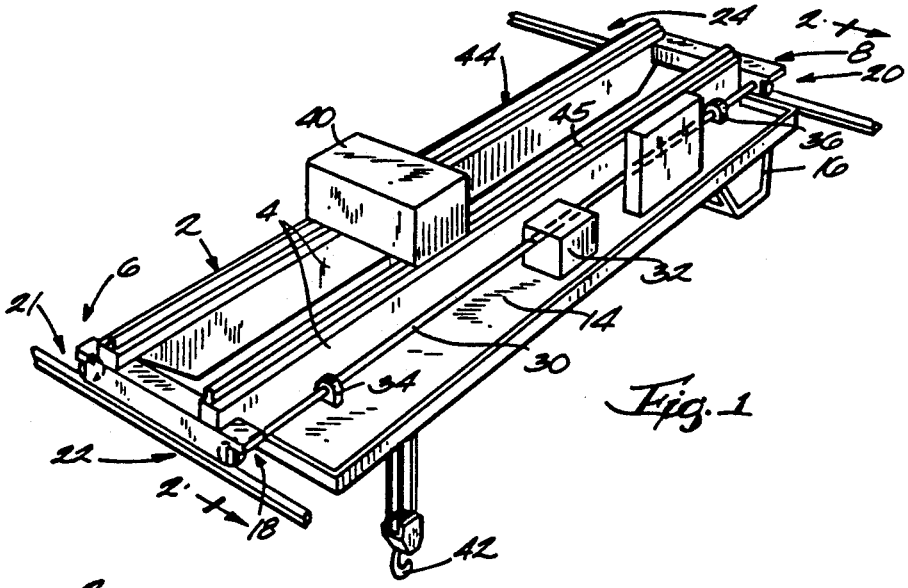
FIG. 1 is a perspective view of a traveling crane incorporating the apparatus of the invention.
Figure 2:
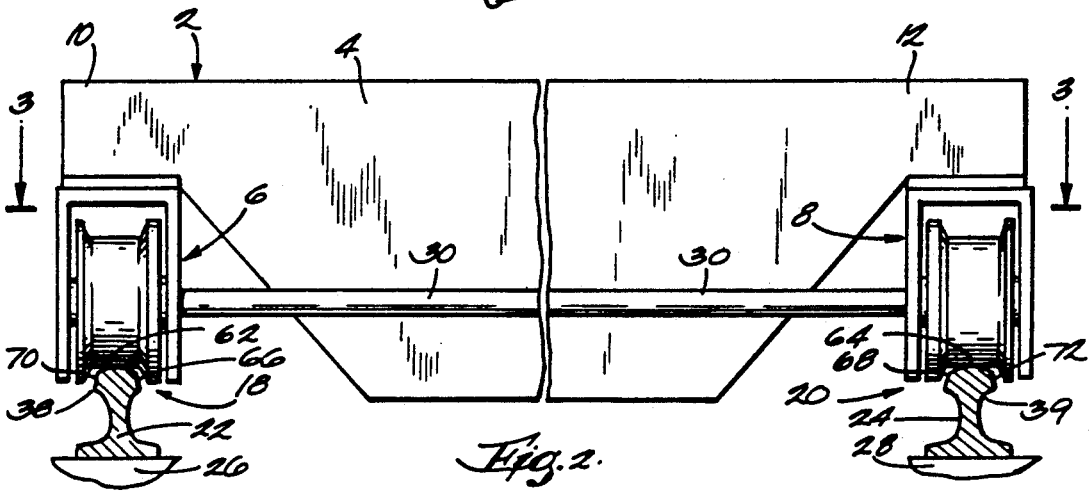
FIG. 2 is a front elevation view, in cross-section taken along lines 2—2 of FIG. 2 and partially broken away, of the crane illustrated in FIG. 1.

Referring generally to FIGS. 1 and 2, an overhead traveling crane is shown as having a frame 2 including a pair of bridge cross-members 4, trucks 6 and 8 respectively at opposite ends 10 and 12 of the cross-members 4, and a footwalk 14. An operator's cab 16 is suspended from the frame 2. Drive wheels 18 and 20 are respectively rotatably mounted on the trucks 6 and 8 in engagement with the rails 22 and 24 so that the latter support the crane. Additional nondriven wheels 21 and 23 are respectively rotatably mounted on the trucks 6 and 8 in engagement with the rails 22 and 24 for support of the crane. The rails are mounted on beams 26 and 28 or other suitable foundation means. The rotatable engagement of the drive and nondriven wheels with the rails 22 and 24 permits travel of the crane along the rails.

A shaft 30 driven by motor drive means 32 and supported by the drive means 32 and journal boxes 34 and 36 interconnects the two drive wheels 18 and 20 so that they have the same rotational speed as they travel along the rails 22 and 24. A hoist 40 having a load hook 42 is supported for travel on tracks 44 and 45 which are mounted on the cross-member 4 of the crane. The hoist 40 also includes motors (not shown) for moving the hoist 40 along the tracks 44 and 45 and for raising and lowering the load hook 42. The crane may be operated by well-known controls, not shown, which control the operation of the motor drive means 32, the movement of the hoist 40 on the tracks 44 and 45 and the raising and lowering of the load hook 42.

Figure 4:
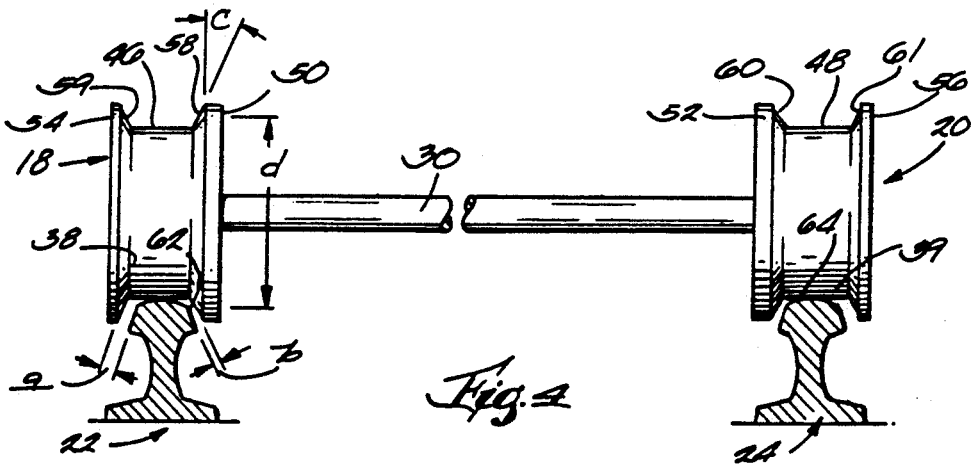
FIG. 4 is a front elevation view showing only the drive wheels of the crane of FIGS. 1-3 on the rails in a parallel, non-skewed traveling position.

With reference to FIGS. 2 and 4, the drive wheels 18 and 20 are respectively shown engaging rails 22 and 24 in a position in which the crane is traveling in a position parallel to the rails 22 and 24. The wheels 18 and 20 respectively include cylindrical surfaces 46 and 48 each having a single diameter along its axial width. The wheels 18 and 20 also respectively include first inside flanges 50 and 52 respectively adjoining cylindrical surfaces 46 and 48 along circumferential junctures 49 and 51 and second outside flanges 54 and 56 respectively adjoining cylindrical surfaces 46 and 48 along circumferential junctures 55 and 57, as shown in FIGS. 2 and 4. The rails 22 and 24 respectively include heads 38 and 39 having top surfaces 62 and 64, inner side surfaces 66 and 68, and outer side surfaces 70 and 72. The inside flanges 50 and 52 of the wheels respectively include circumferentially inside walls 58 and 60 which respectively face inner side surface 66 of rail head 38 and inner side surface 68 of rail head 39. The outside flanges 54 and 56 of the wheels 18 and 20 respectively include circumferential inside walls 59 and 61 which, in turn, respectively face outer side surface 70 of rail head 38 and outer side surface 72 of rail head 39. The side surfaces 66 and 68 may have a taper in a downward direction and respectively axially toward flanges 50 and 52. The side surfaces 70 and 72 may have a taper in a downward direction and respectively axially toward the flanges 54 and 56. The float or clearance distance a between the inside wall 59 of the outside flange 54 and the outer side surface 70 of the rail head 38 is greater than the float or clearance distance b between the inside wall 58 of the first inside flange 50 of wheel 18 and the inner side surface 66 of rail head 38, as can be seen in FIG. 4. The same spacing relationship exists with respect to the flanges of drive wheel 20 and the rail head 39. Desirable clearance distances are, for example, $\frac{3}{4}$ inch for a and $\gtrsim$ inch for b. It should be understood, however, that other clearance distances may be used so long as the clearance distance b between the inside flange of the drive wheel and the rail head is always less than the clearance distance a between the outside flange of the drive wheel and the rail head.

The inside walls 58 and 60 of the flanges 50 and 52 also preferably have a taper at an angle c extending in a radially outward direction and axially away from the rails the walls face as shown in FIG. 4. The preferred value of the angle c of the walls 58 and 60, with respect to a radial plane perpendicular to the axis of the wheels 18 and 20 has been found to be 15 degrees, however, it is not intended that the position of the walls 50 and 60 be limited to only such an angle. The taper angle of the rail head side surfaces 66, 68, 70 and 72 may, for example, be the same as the taper angle of the flange wall which each side surface faces. The inside flanges 50 and 52 have a larger diameter than the diameter of the cylindrical surfaces 46 and 48 of the wheels 18 and 20. As can be seen in FIG. 4, the diameters of the inside flanges 50 and 52 designated by the letter d, increases along the inside walls 58 and 60 due to the taper of these walls from a location near the adjoining of the walls 58 and 60 to the cylindrical surfaces 46 and 48, respectively, to a maximum value at the outer circumference of the flanges. The diameter d is identified in FIG. 4 at approximately the midpoint between the maximum and minimum diameter values.

The positioning of the first inside flanges 50 and 52 of wheels 18 and 20 at a smaller clearance distance from the side of the rail heads than the clearance distance between the second outside flanges 54 and 56 and the side of the rail heads may be accomplished in several different ways. The wheels 18 and 20 may merely be located on the drive shaft 30 at a position such that the desired clearance difference for each wheel is obtained. However, a more desirable arrangement for providing the clearance differential is to machine each wheel 18 and 20 with an axially thicker first inside flange 50 and 52 and an axially thinner second outside flange 54 and 56. The wheels 18 and 20 are then located on the shaft 30 at an axial position in which the full width of each wheel is centered above the rail on which it rides. The latter approach provides a further benefit, where there is no change in the thickness of the entire wheel, of having a thicker and thereby stronger inside flange that receives the most wear due to its greater amount of rail contact than that of the outside flange.

Figure 3:
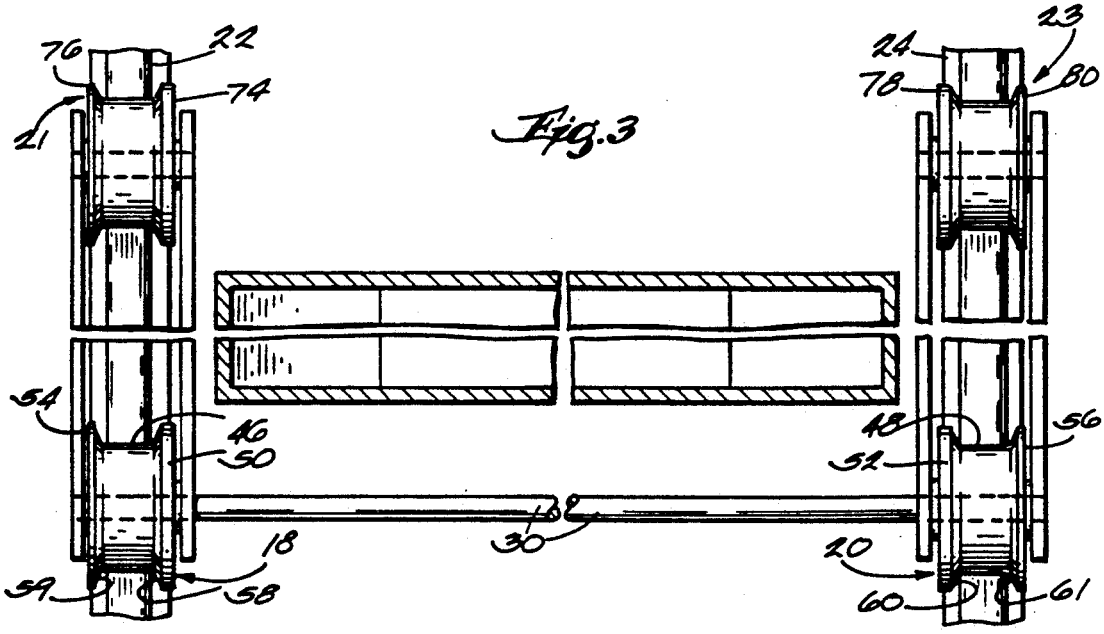
FIG. 3 is a plan view, in cross-section taken along lines 3—3 of FIG. 2 and partially broken away, of the crane illustrated in FIGS. 1 and 2.

The nondriven wheels 21 and 23 are respectively positioned in alignment in direction of the rails with drive wheels 18 and 20 as shown in FIG. 3. The wheel 21 includes radially extending circumferential flanges 74 and 76 which respectively face and are spaced from the inner side surface 66 and outer side surface 70 of rail head 38. The wheel 23 includes radially extending circumferential flanges 78 and 80 which respectively face and are spaced from the inner side surface 68 and the outer side surface 72 of the rail head 39. The clearance space or distance of both flanges of each wheel 21 and 23 is most desirably at least equal to or greater than the clearance distance b between the inside flange walls 59 and 61 and their respective facing outer side surfaces 70 and 72 of the rail heads.

Figure 5:
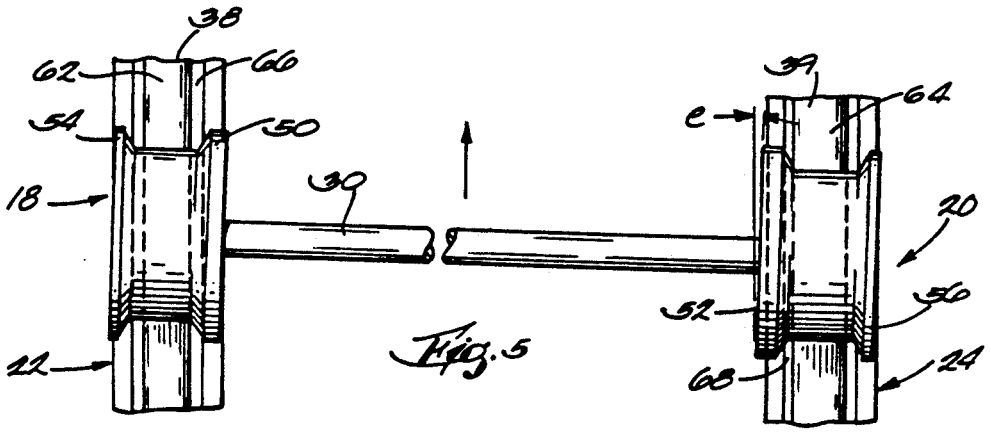
FIG. 5 is a plan view showing only the drive wheels of the crane in a skewed position on the rails with the angle of the skew exaggerated for illustrative purposes.
Figure 6:
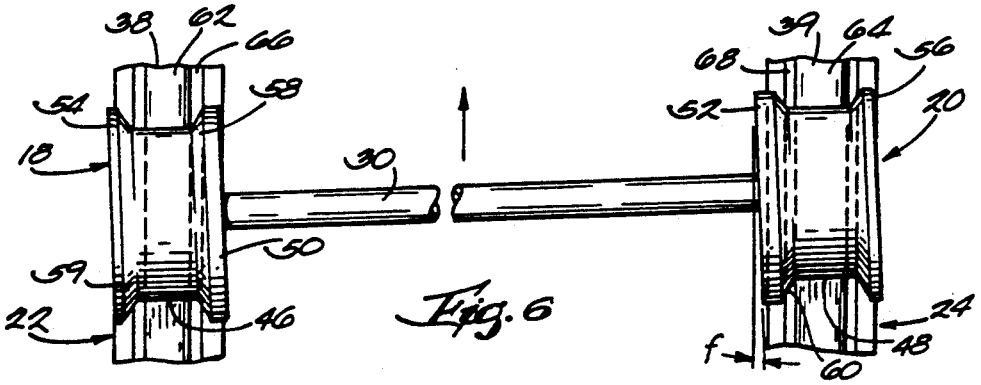
FIG. 6 is a plan view showing only the drive wheels of the crane shown in a skewed position on the rails opposite to the skewed position shown in FIG. 5 with the angle of the skew exaggerated for illustrative purposes.

The crane has a normally parallel position during its travel in which it moves in a direction parallel to the rails 22 and 24 and the wheels 18 and 20 respectively travel on the rails 22 and 24 in the positions shown in FIG. 3. Although the rails 22 and 24 are generally parallel, they may also in many cases be somewhat displaced from their parallel relationship at various places along their length for the reasons as previously discussed. Also, traction of the wheels 18 and 20 on the rails 22 and 24 is affected by moisture, particles or other material on the rails or wheels or both. As a consequence of either lack of rail parallelism or traction problems, if the rotation of either wheel 18 or 20 is delayed by contact with one of the rails 22 or 24 or by slippage, the position of the delayed wheel will lag the other wheel which will then become the leading wheel. In some instances, the amount of lag of one wheel relative to the other wheel will be small and the lagging wheel will catch up with the leading wheel to return the crane to its parallel travel position. Frequently, however, the skew force will be more extreme and the wheels will move to their maximum lagging and leading positions relative to each other which is determined by the skew angles at which the flange wall 58 engages the rail head surface 66 and the flange wall 60 engages the rail head surface 64 as shown in FIGS. 5 and 6. In FIGS. 5 and 6, the skew angles are respectively designated skew angles e and f. As stated in the description of the drawings, the angle of skew in FIGS. 5 and 6 is exaggerated for illustration purposes herein.

Figure 7:
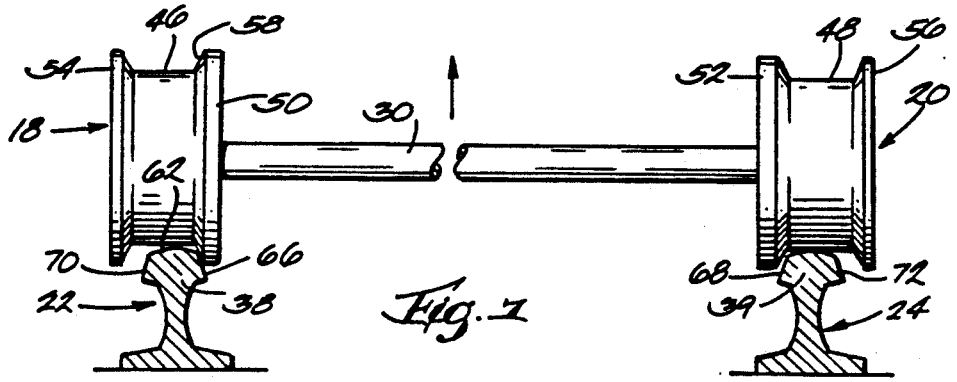
FIG. 7 is a front elevation view of only the drive wheels of the crane of FIGS. 1-3 in a skewed position in which the lagging skewed wheel is in a position causing the correction of the skew.

The correction of the skewing is accomplished in accord with the invention in the same way whether the lagging wheel is drive wheel 18 or drive wheel 20. Consequently, only the correction of the skewed condition shown in FIG. 6 in which wheel 18 is the lagging wheel and wheel 20 is the leading wheel will be described in detail. As shown in FIG. 6, in the skewed position of the crane traveling in the direction of the arrow on the rails 22 and 24, the inside wall 58 of the first inside flange 50 of the drive wheel 18 engages the inner side surface 66 of the rail 22. In the travel direction of the crane and wheels at the skew angle shown in FIG. 6, the wheel 18 has a linear path of travel transverse to the rail 22 which is toward the rail head 38. As the wheel 18 follows this travel path, the flange 50 rotates into and against the inner side surface 66 of the rail head 38. This motion of the flange 50 causes it to rotate on to the side surface 66 of the rail head 38 at the larger diameter of the inside wall 58 of the flange 50, as illustrated in FIG. 7, rather than at the smaller diameter of the cylindrical surface 46 as illustrated in FIG. 4. The rotation of the inside wall 58 against the rail side surface 66 at a larger diameter area will, in turn, cause the wheel 18 to travel at a higher linear speed than the linear speed of the wheel 20 which continues to travel along its cylindrical surface 48 on the surface 64 of the head 39 of rail 24. Thus, since the wheels 18 and 20 are interconnected so that they both rotate at the same speed, the higher linear speed of the lagging wheel 18 will cause it to catch up with the leading wheel 20 and correct the skew. The crane thus is returned to its parallel position on the rails 22 and 24.

As previously described, the clearance distances b between the flange wall 58 and the rail head surface 66 and between the flange wall 60 and the rail head surface 68 are smaller than the clearance distance a between the flange wall 59 and the rail head surface 70 and between the flange wall 61 and the rail head surface 72. Therefore, only the flange walls 58 and 60 engage the rail head surfaces which they face when the crane is skewed.

As a consequence, the outer flanges 54 and 56 will not engage the rail head and thereby exacerbate the skew or prevent the skew corrective engagement of the flange walls 58 and 60 respectively with the rail head surfaces 66 and 68.

The taper of the inside wall 58 of the flange 50 will usually cause the wheel 18 to "ride up" on to the varying larger diameter d of the wall 58, as shown in FIG. 7, to gain linear speed. The extent to which the wheel 18 rotates against the rail in the direction of the larger diameter of the tapered flange wall 58 will be determined by the amount of skew force of the wheel against the rail. Also, if the inner side surface 66 has a taper, and particularly if the taper is at the same angle as the taper angle of the flange wall 58, the contact of the flange wall 58 with the rail head surface 66 will be along a line of contact as the wheel 18 rides up so that the larger diameter d of the wall 58 engages the rail head surface 66. The line contact between wall 58 and surface 66 reduces wear on these surfaces and also increases the load carrying ability of the crane. Due to the skew angle and the direction of rotation of the wheel 18, the wheel 18 is also traveling linearly in the direction of the rail 18. In this regard, it may be noted that the maximum diameter of the flanges 50 and 52 in excess of the diameter of the cylindrical surfaces 46 and 48 may be determined by the flange diameter necessary to provide the increased linear speed to overcome the maximum anticipated skew force.

It should be noted that the nondriven wheels 21 and 23 will also be skewed when the crane is in a skewed position. However, it is necessary that the clearance distance of their flanges from the rail head side surfaces be such that at least a portion of this clearance distance remains even when the crane is skewed. Thus, the flanges of the wheels 21 and 23 will not engage the sides of the rail heads and interfere with the engagement of the rail head sides by drive wheels 18 and 20 and the correction of the skew.

An apparatus and method has been described in which skewing of an overhead crane traveling on parallel rails and having drive wheels driven at the same rotational speed will quickly and readily correct the skewed condition. Moreover, the skew correction is accomplished without the need for any additional sensing or corrective apparatus beyond the drive wheels and ordinary drive mechanism of the crane.

It will be understood that the foregoing description of the present invention is for purpose of illustration and that the invention is susceptible to a number of modifications or changes none of which entail any departure from the spirit and scope of the present invention as defined in the hereto appended claims.

What is claimed is:

1. In a traveling crane supported on a pair of spaced apart generally parallel rails and including a frame spanning the space between the rails, a truck attached to the frame adjacent each rail, at least one wheel rotatably mounted on each truck in engagement with one of the rails for movement at a linear speed in the direction of the parallel rails whereby the crane travels along and in a position parallel to the rails, the crane also having two oppositely skewed positions while traveling on the rails such that a first wheel and a second wheel on two trucks respectively have relative leading and lagging positions when the crane is in one of the skewed positions, and opposite leading and lagging position when the crane is in the other of the skewed positions, and drive means for rotatably driving the first and second wheels, a combination comprising:

means for interconnecting the first and second wheels such that they rotate at the same speed;

each rail including a head having a top side, an inner side and an outer side;

each of the first and second wheels having a single diameter cylindrical surface engaging a rail head and first and second axially spaced apart radially extending circumferential flanges having a larger diameter than that of the cylindrical surface, each first and second flange having an inside wall adjoining the cylindrical surface of one of the first and second wheels along a circumferential juncture, the inside wall of each flange extending from its circumferential juncture to the outer circumference of the flange, the circumferential junctures of the first and second flanges respectively facing and spaced from the inner side and the outer side of a rail head when the crane is in said position parallel to the rails, the distance of the space of the circumferential juncture of the first flange of the first wheel from the inner side of the rail head which the first flange of the first wheel faces being less than the distance of the space of the circumferential junctures of the second flange of the first wheel from the outer side of the rail head which the second flange of the first wheel faces, the distance of the space of the circumferential juncture of the first flange of the second wheel from the inner side of the rail head which the first flange faces being less than the distance of the space of the circumferential juncture of the second flange of the second wheel from the outer side of the rail head which the second flange of the second wheel faces, the distance of the space of the inside wall of the first flange of each of the first and second wheels from the inner side of the rail head which the first flange of said wheels each face being such that only the first flanges of the first and second wheels engage the sides of the rail heads when the crane is in one of the skewed positions whereby the lagging wheel of the first and second wheels in said one skewed position rotates its first flange against and on to the rail head at said larger diameter than the diameter of the cylindrical surface of the leading wheel of the first and second wheels in said one skewed position so that the lagging wheel travels at a higher linear speed and thereby moves the crane to said parallel position.

2. The combination according to claim 1 wherein:

the inner side of each rail head extends at an angle away from the rail head of which the inner side comprises a part; and the first flanges each have a circumferential side wall facing the inner side of a rail head, the side wall extending radially at an angle away from the faced rail head and engaging the faced rail head when the crane is in a skewed position whereby the angles of the side wall and the inner side of the faced rail head facilitate the rotation by the lagging wheel of its first flange on to the inner side of the rail head at the larger diameter of the first flange.

3. The combination according to claim 2 wherein the circumferential side wall has a diameter increasing in the radial direction, the lagging wheel rotating on the inner side of the rail head at a diameter of the circumferential side wall determined by the skew force on the lagging wheel.

4. The combination according to claim 1, 2 or 3 wherein the lagging one of the first and second wheels rotates in a direction such that the wheel path of linear travel is toward and on to the rail head at said larger diameter of the first flange of the lagging one of the wheels.

5. The combination according to claim 1, 2 or 3 wherein the second flange of each wheel has a smaller axial thickness than the axial thickness of the first flange of each wheel.

6. The combination according to claim 1, 2 or 3 wherein the lagging one of the first and second wheels has a linear path of travel transverse to the rail head with the larger diameter of the first flange of the lagging one of the wheels rotating on the rail head.

7. In a traveling crane supported on a pair of spaced apart generally parallel rails and including a frame spanning the space between the rails, a truck attached to the frame adjacent each rail, at least one wheel rotatably mounted on each truck in engagement with one of the rails for movement at a linear speed in the direction of the parallel rails whereby the crane travels along and in a position parallel to the rails, the crane also having two oppositely skewed positions while traveling on the rails such that a first wheel on one of the trucks and a second wheel on the other of the trucks respectively have relative leading and lagging positions when the crane is in one of the skewed positions, and drive means for rotating the first and second wheels, a combination comprising:

means for interconnecting the first and second wheels such that they rotate at the same speed;

each rail including a head having a top side, an inner side and an outer side;

the first and second wheels each have a flat, cylindrical surface engaging a rail head and first and second axially spaced apart radially extending circumferential flanges each having a circumferential juncture with the cylindrical surface;

the circumferential junctures of the first and second flanges of each wheel respectively facing and spaced from the inner side and the outer side of the rail head in engagement with said each wheel, the distance of the space of the juncture of the first flange of each of the first and second wheels from the inner side of the rail head which the first flange of said wheels each face being less than the distance of the space of the juncture of the second flange of each of the first and second wheels from the outer side of the rail head which the second flange of said wheels each face;

the first flanges of the first and second wheels engaging the sides of the rail heads when the crane is in one of the skewed positions due to said lesser spacing distance of the first flanges of the first and second wheels; and the lagging wheel of the first and second wheels, when the crane is in one of said skewed positions, engaging and traveling on the first flange along a path which is toward and on tot he rail head along a diameter of the first flange larger than the diameter of the cylindrical surface of the leading wheel whereby the linear speed of the lagging wheel increases to a value greater than the linear speed of the leading wheel of the first and second wheels to bring the crane to a parallel position on the rails.

8. The combination according to claim 7 wherein only the first flanges of the first and second wheels engage the sides of the rail heads when the crane is in one of the skewed positions.

9. The combination according to claim 7 or 8 wherein the lagging one of the first and second wheels has a linear path of travel transverse to the rail head with the larger diameter of the first flange of the lagging one of the wheels rotating on the rail head.

10. A method of correcting skew of an overhead crane having a plurality of wheels traveling on a pair of generally parallel rails, the plurality of wheels including a pair of drive wheels each having a center cylindrical portion and first and second flanges adjoining the center portion along circumferential junctures and having a larger diameter than the center portion, the cylindrical portion engaging a top side of a head of a rail, the first flanges facing an inner side of the head of a rail and the second flanges facing an outer side of the head of a rail, comprising the steps of:

positioning the circumferential juncture of the first flange at a smaller clearance distance from the inner side of the rail head it faces than the clearance distance of the circumferential juncture of the second flange from the outer side of the rail head so that only the inner sides of the rail heads are engaged by the first flanges of each wheel when the crane becomes skewed; and driving the pair of wheels at the same rotational speed when the crane is skewed and one of the pair of wheels becomes a lagging wheel to rotate the first flange of the lagging wheel on to the rail head that the first flange engages and increase the linear speed of the lagging wheel to correct the skew due to the larger diameter of the first flange of the lagging wheel engaging the rail head as the lagging wheel rotates.

11. The method according to claim 10 further comprising the step of driving the skewed crane in a direction parallel to the pair of rails prior to the correction of the skew.

* * * * *